United States Patent [19]

Shimizu

[11] 4,230,159

[45] Oct. 28, 1980

[54] HEDDLE FRAME

[75] Inventor: Yoichi Shimizu, Izumishi, Japan

[73] Assignee: Kabushiki Kaisha Maruyama Seisakusho, Sakaishi, Japan

[21] Appl. No.: 971,557

[22] Filed: Dec. 20, 1978

[30] Foreign Application Priority Data

Jun. 21, 1978 [JP] Japan ..... 53-84033[U]

[51] Int. Cl.[2] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 632,834 | 9/1899 | Cocker | 139/91 |
| 3,335,759 | 8/1967 | Koch | 139/91 |
| 3,604,469 | 9/1971 | Schneiter et al. | 139/91 |
| 4,022,252 | 5/1977 | Ogura | 139/91 |

*Primary Examiner*—Henry Jaudon

*Attorney, Agent, or Firm*—Oblon, Fisher, Spivak, McClelland & Maier

[57] ABSTRACT

An improved heddle frame for a weaving machine. The heddle frame consists of a pair of lateral beams and a pair of side stays attached thereto. Each lateral beam has an inner hollow portion at each end while the side stays have a projection at each end which is inserted into a hollow end portion of a lateral beam. Each projection is freely rotatably fixed in its respective hollow end portion by a pin. The upper surface and lower surface of each projection respectively contact the upper and lower inner surfaces of its respective hollow end portion while said upper and lower surfaces of each projection form a circular surface, the center of which is on the axial horizontal center line of its respective pin.

5 Claims, 5 Drawing Figures

HEDDLE FRAME

BACKGROUND OF THE INVENTION

1. Field of the Invention

The present invention relates to the improvement of a heddle frame.

2. Description of the Prior Art

A heddle frame as generally used in a weaving machine is composed of a pair of lateral beams 1' and a pair of side stays 2' as shown in FIG. 1A. A projection 3' formed at an inner end of a side stay 2 is connected to an inner hollow end portion 4' of said lateral beam 1', whereby the end portion of the lateral beam 1' and the end portion of the side stay 2' are fixed tightly.

However, in an ordinary heddle frame, the outer periphery of the side stary 2' which is fitted to freely slide into a guide groove formed in a guide apparatus, is vertically moved upwards or downwards by actuating the side stays by the aid of a dobby and shedding motion which is performed vertically, during which motion the pair of lateral beams 1', 1', remain in a free state. Therefore, the inertia force caused by the vertical shedding motion is applied to the upper lateral beam 1' and the lower lateral beam 1', whereby the pair of the lateral beams 1' have the tendency to bend into a convex state toward upper direction during the upward stroke of the vertical motion thereof as shown in FIG. 1A, and the pair of the lateral beams 1' have the other tendency to bend in a convex state toward lower direction during the downward stroke of the vertical motion, as shown in FIG. 1B. These tendencies are especially acute in the case of a high speed weaving machine operated with a rotation of 300 rpm to 600 rpm.

Further, the strength of the side stay 2' is too strong for it to be bent as shown in FIG. 1A or in FIG. 1B; generally the strength of the side stay 2' being stronger than that of the lateral beam 1'. As a result, a large bending moment is applied to the connection portion of the side stay 2' and the lateral beam 1'. Moreover, this large bending moment is applied alternately and there arises the possibility that the connection portion of the side stay 2' and the lateral beam 1' can be damaged or cut off.

Further, in the case of the connection by a bolt and a nut at the connection portion of the side stay 2' and the lateral beam 1', the tightness by the bolt and the nut may be loosened by the alternate large bending moment applied to the connection portion of the side stay 2' and the lateral beam 1'. This loosening induces noise pollution during the shedding motion of the ordinary heddle frame.

Recently, the weaving speed of newer weaving machines has increased. This high speed motion requires that every part possess more strength, and that every part become relatively complex and heavy. The inertia due to the weight of the heddle frame thus becomes larger. Therefore, every part is bent more by the larger inertia force, and the life of the heddle frame becomes shorter, and there arises a defect that a tremendous noise is produced by the friction arising in the transmission system.

To delete the defects mentioned above, there are many cases in which a lightweight aluminum hollow body is used as a lateral beam. However, the bending tendency of the lateral beam of aluminum cannot be completely eliminated and there remains the defect that the connection portion of the side stay and the lateral beam has the strong tendency to deteriorate.

SUMMARY OF THE INVENTION

The present invention has as one of its objects the elimination of the above-mentioned defects. The improved feature of the present invention consists of the arrangement such that a projection formed at the inner side of a side stay is inserted into the inner hollow end portion of a lateral beam. The projection and the inner hollow end portion are connected by a horizontal pin to rotate in a free state. The upper surface of the projection and the lower surface of the projection respectively contact the inner upper surface of the inner hollow end portion of the lateral beam and the inner lower surface of the inner hollow end portion of the lateral beam which is respectively formed in a circular surface the center of which is on the axial horizontal center line of the pin connecting the projection formed at the inner side of the side stay and the inner end hollow portion of the lateral beam. According to the arrangement of the present invention, the bending moment applied to the connection portion of the side stay projection and the inner end hollow portion can be greatly decreased, because the contacting surfaces of the projection can slide on the inner contacting surface of the inner end hollow surface of the lateral beam, and the force which permits relative rotation between the projection of the side stay and the inner end hollow portion of the lateral beam can be much decreased and eliminated. As a result, breaking down of the heddle frame can be prevented, there arises little noise because of the decrease of friction, and the heddle frame according to the present invention can endure a longer operation. Another of the objects of the present invention therefore is to provide a heddle frame which can be operated effectively in the high speed weaving machine.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The present invention will now be explained in detail according to the preferred embodiment in the accompanying drawings of FIG. 2 and FIG. 3 and FIG. 4.

Figure 1A:
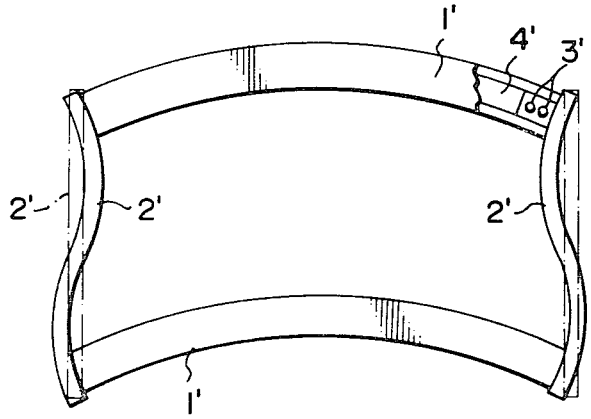
FIG. 1A and FIG. 1B are respectively the explanatory drawings which show the state of bending of an ordinary heddle frame during the shedding motion thereof.
Figure 1B:
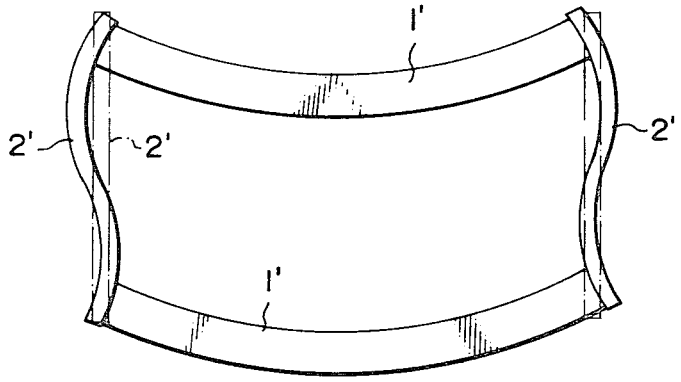
Figure 2:
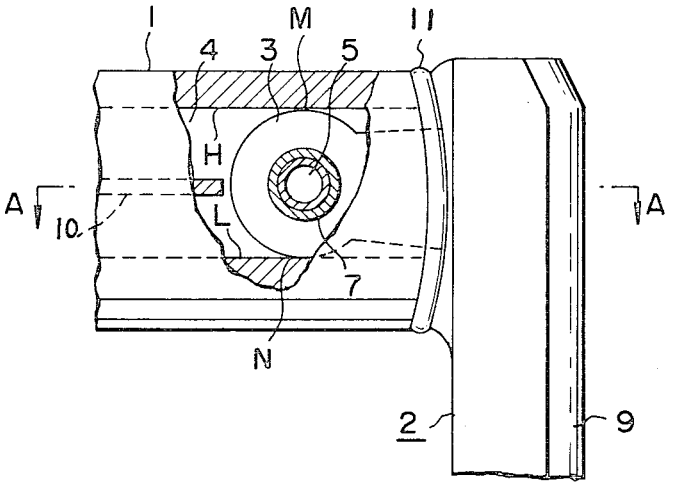
FIG. 2 is a partially cut side view of one of the corners of the heddle frame in FIG. 4 which shows the connecting portion of the edge portion of the side stay and the edge portion of the lateral beam of the preferred embodiment of the heddle frame according to the present invention.
Figure 3:
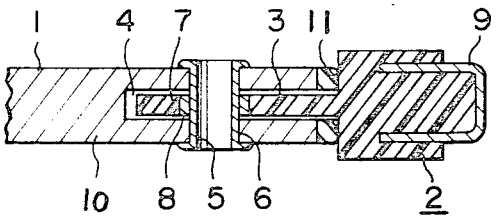
FIG. 3 is a sectional view of FIG. 2 which is cut along the line A—A shown in FIG. 2.
Figure 4:
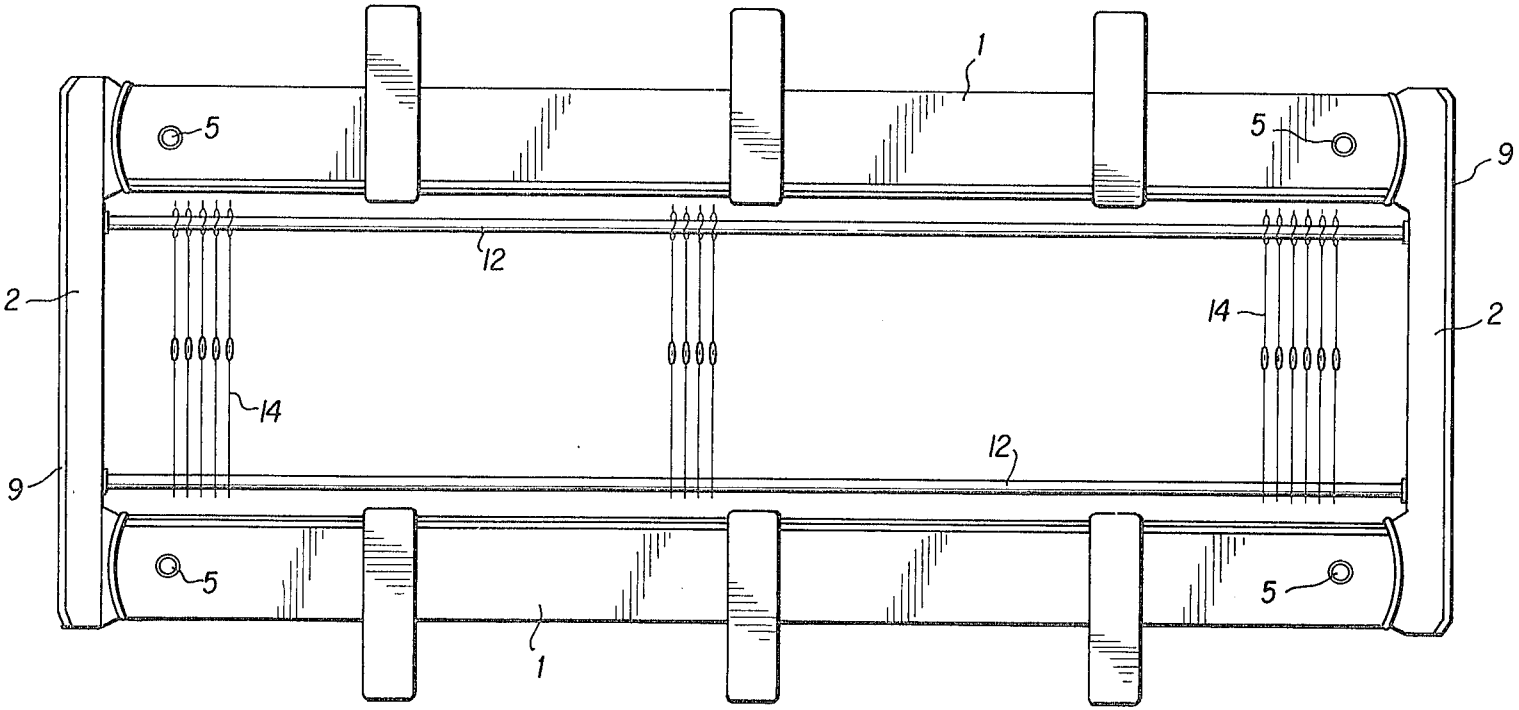
FIG. 4 is a side view of the heddle frame according to the present invention.

In FIG. 2 and in FIGS. 3, and 4, the numeral 1 denotes a lateral beam made of aluminum which is produced by a solid-drawn process and the numeral 2 denotes a side stay. The numeral 3 denotes a projection elongated from the inner side of the side stay 2, the projection 3 being inserted into the inner end hollow portion 4 at the end portion of the lateral beam 1.

The numeral 5 denotes a horizontal pin connecting the projection 3 and the lateral beam 1. The horizontal pin 5 is in the form of a cylinder, and penetrates the opening 6 and the opening 7 respectively drilled in the lateral beam 1 and the projection 3. Both ends of the horizontal pin 5 are respectively caulked. The numeral 8 denotes a bush inserted into the opening 7 drilled in the projection 3. The bush 8 reduces the friction between the horizontal pin 5 and the inner surface of the opening 7 drilled in the projection 3.

Further, the numeral 10 denotes a reinforcing rib formed in a body in or near the central portion of the inner hollow end portion 4 of the lateral beam 1. The reinforcing rib 10 reinforces the lateral beam 1 and its end is clipped enough to allow the insertion of the projection 3.

The numeral 12 represents a heddle support rail while numeral 14 represents a plurality of heddles.

Now, in the present invention, the upper surface M of the projection 3 and the lower surface N of the projection 3, respectively contacting the upper surface H of the inner end hollow portion 4 of the lateral beam 1 and the lower surface L of the inner end hollow portion 4 of the lateral beam 1, are respectively formed on a circular surface the center of which is on the axial horizontal center line of the horizontal pin 5. Therefore, if the lateral beam 1 is bent in the convex state toward upper direction or in the convex state toward lower direction, the end portion of the lateral beam 1, can rotate respectively on the upper circular surface M of the projection 3 and on the lower surface N of the projection 3, the center of this rotation being on the axial center line of the horizontal pin 5. Therefore, the lateral beam 1 can bend freely without friction and without noise.

The side stay 2 according to the present invention is made from synthetic resins. However, the outer periphery of the side stay 2 is slidably mounted into a groove formed in a guide tool, (not shown), and it is necessary, as a part of the heddle frame according to the present invention, that the heddle frame have sufficient strength for high speed weaving machines. Therefore, a metallic guide tool 9 having a U-shape is mounted on the outer periphery of the side stay 2 and synthetic resin is poured between the outer side of the side stay 2 and the inner side of the U-shape of the metallic guide tool 9, whereby the side stay 2 and the metallic guide tool 9 of U-shape are formed in a body.

Further, according to the preferred embodiment of the present invention, the upper projection 3 and the lower projection 3 of the side stay 2 are respectively formed in a body with said side stay 2. The projection 3 may alternatively be made independently and then the projection 3 may be fixed to the side stay 2 by such fixing means as a bolt and a nut and a pin.

However, if the lateral beam 1 is made of such metallic material as aluminum, in the case of a lateral beam 1 and projection 3 made of metallic material, metallic noises arise at the moment when the lateral beam 1 is bent upwards or downwards during the shedding motion of the heddle frame, the metallic noises being caused by the contact and the rotation between the circular surfaces M and N of the projection 3 and the upper and the lower surfaces of the inner end hollow portion 4 respectively. In this case, the working environment around the heddle frame made of metallic material such as aluminum deteriorates. Therefore, to delete these noises arising from metallic contact, it is preferable that the projection 3 is made from synthetic resin.

Moreover, according to the preferred embodiment of the present invention, packing material 11 is inserted between the edge portion of the lateral beam 1 and the inner end side portion of the side stay 2. The objects of the insertion of the packing material 11 are, first, to decrease the vibration noise arising in respective edge portions of the side stay 2 and the lateral beam 1 during the shedding motion of the heddle frame, second, to absorb effectively the action of the bending moment caused by the bending of the lateral beam 1 and prevent the transmission of the bending moment to the side stay 2 and, third, to preserve the whole figure of the heddle frame in a rectangular form when the heddle frame is mounted on a high speed weaving machine.

As described in detail above, the heddle frame according to the present invention comprises an upper projection at the upper inner side of the side stay and a lower projection at the lower inner side of the side stay respectively inserted into the inner end hollow portion of the upper lateral beam and into the inner end hollow portion of the lower lateral beam, a horizontal pin connecting the projection and the lateral beam in a free state so as to be able to rotate, the upper surface of the projection and the lower surface of the projection respectively contacting the inner upper surface of the inner hollow end portion and the inner lower surface of the inner hollow end portion which are respectively so formed as to be a circular surface the center of which is on the axial horizontal center line of said horizontal pin. Therefore, there are at least four advantages with respect to the heddle frame according to the present invention, as follows:

(1) As the edge of the lateral beam can rotate around the center line of the horizontal pin, bending of the lateral beam caused by shedding motion of the heddle frame is not prevented at all and little bending moment is applied to the connecting portion of the lateral beam and the side stay. Therefore, the defect that after an operation of short period, the connecting portion of the lateral beam and the side stay was broken down or cut is eliminated.

(2) As the lateral beam and the projection are connected to each other by the horizontal pin, in the case of the lateral beam bending, there arises no loosening with respect to the connection between the lateral beam and the side stay. Therefore, there arises no noise caused by loosening thereof.

(3) As the edge portion of the lateral beam is supported not only by the horizontal pin but also by the upper surface of a circular form of the projection and the lower surface of a circular form of the projection, the connection of the lateral beam and the side stay is stable.

(4) As the arrangement of the heddle frame according to the present invention is very simple, it is produced with a low price and also it can be easily assembled or it can be easily disassembled.

As described above, the heddle frame according to the present invention has at least four advantages and is especially suitable for a high speed weaving machine. Therefore, the present invention can provide a practically very convenient heddle frame.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A heddle frame comprising a pair of projections elongated respectively from an upper portion of an inner side of a side stay and a lower portion of said inner side of said side stay, and respectively inserted into an inner hollow end portion of a lateral beam; a pin freely rotatingly connecting said lateral beam and said projection; the upper surface and the lower surface of said projection which respectively contacts the upper inner surface and the lower inner surface of said inner hollow end portion of said lateral beam being so made as to form a circular surface the center of which is on the axial horizontal center line of said pin.

2. The heddle frame of claim 1, wherein said projection is so made as to be in a body with said side stay.

3. The heddle frame of claim 1, wherein said lateral beam is made of an aluminum hollow body.

4. The heddle frame of claim 1, wherein a packing is inserted between the end surface of said lateral beam and the inner side end portion of said lateral stay.

5. The heddle frame of claim 1, wherein said projection is made of synthetic resin.

* * * * *